US007244510B2

(12) United States Patent
Van Den Abbeele et al.

(10) Patent No.: US 7,244,510 B2
(45) Date of Patent: Jul. 17, 2007

(54) VAPOR SCREEN COMPOSITION

(75) Inventors: Henk Jan Frans Van Den Abbeele, Diest (BE); Tomi Kimpimäki, Masku (FI)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 7 days.

(21) Appl. No.: 10/526,177

(22) PCT Filed: Sep. 4, 2003

(86) PCT No.: PCT/EP03/09993

§ 371 (c)(1),
(2), (4) Date: Mar. 1, 2005

(87) PCT Pub. No.: WO2004/022647

PCT Pub. Date: Mar. 18, 2004

(65) Prior Publication Data

US 2006/0014014 A1 Jan. 19, 2006

(30) Foreign Application Priority Data

Sep. 4, 2002 (EP) ..... 02078734

(51) Int. Cl.
*B32B 5/16* (2006.01)

(52) U.S. Cl. ..... 428/537.5; 428/532; 428/535; 428/536; 524/525

(58) Field of Classification Search ..... 428/537.5, 428/532, 535, 536; 524/525
See application file for complete search history.

(56) References Cited

U.S. PATENT DOCUMENTS

| | | | | |
|---|---|---|---|---|
| 3,259,596 | A | 7/1966 | Downer et al. | 260/17.4 |
| 4,290,931 | A | 9/1981 | Nölken et al. | 260/29.6 |
| 5,527,623 | A | 6/1996 | Takahira et al. | 428/498 |
| 5,559,175 | A | 9/1996 | Kroggel et al. | 524/297 |
| 6,121,349 | A | 9/2000 | Fischer et al. | 523/412 |
| 6,407,197 | B1 | 6/2002 | Van Den Berg et al. | 528/170 |
| 6,531,196 | B1 * | 3/2003 | Aho et al. | 428/34.2 |
| 6,830,657 | B1 | 12/2004 | Betremieux et al. | 162/168.2 |

FOREIGN PATENT DOCUMENTS

| | | |
|---|---|---|
| EP | 0437624 | 7/1991 |
| FR | 2795076 | 12/2000 |
| WO | 03/029560 | 4/2003 |

* cited by examiner

*Primary Examiner*—Leszek Kiliman
(74) *Attorney, Agent, or Firm*—Shiela A. Loggins

(57) ABSTRACT

The invention relates to a water-dispersible composition for making a water repellent paper with a low permeability for moisture. The composition comprises components (A) to (H), in the following amounts by dry weight (wt): (A) 5 to 89 wt % of polyvinyl butyral (PVB), (B) 1 to 20 wt % of styrene maleic imide (SMI), (C) 5 to 50 wt % of ethylene acrylate, (D) 0 to 20 wt % of polyvinyl alcohol or starch, (E) 0 to 7 wt % of wax, (F) 0 to 6 wt % of styrene maleic anhydride copolymer (SMA), (G) 0 to 70 wt % of styrene butadiene (SB) latex and (H) 0 to 70 wt % of talc. The invention further relates to an easily macerating moisture-proof paper comprising a base paper having coated on at least one surface thereof a layer of an aqueous emulsion comprising a water-dispersible composition, wherein the solid content in the aqueous emulsion is from 30 to 65 % by weight.

13 Claims, No Drawings

VAPOR SCREEN COMPOSITION

FIELD OF THE INVENTION

The present invention relates to a water-dispersible composition, with a low permeability for gas and moisture and a moisture-proof paper, paperboard or cardboard made using the foregoing composition.

BACKGROUND OF THE INVENTION

Recently, from the standpoint of saving resources, a demand of collecting used papers and regenerating fibres after dissolving the papers in water has been increased. It is required for the papers meeting the demand to have a so-called easily macerating property, that is, when the paper is dissolved in water the paper is easily macerated into fine fibrous forms.

A composition for making an easily macerating moisture proof paper is known from U.S. Pat. No. 5,527,623. Example 8 of U.S. Pat. No. 5,527,623 describes aqueous emulsion comprising components (X), (Y) and (Z), wherein component (X) is an ethylene-vinyl chloride series copolymer comprising 20% by weight ethylene, 41% by weight vinyl chloride, and 39% by weight vinyl acetate having a glass transition temperature of from 0° C., component (Y) is an emulsion of a rosin ester having a softening point of 125° C. and component (Z) is an emulsion of a wax having a melting point of 57° C. Applied on a paper having a base weight of 80 g/m$^2$ in an amount of 20 g/m$^2$ the coated paper had a moisture permeability of 19 g/m$^2$, 24 h.

SUMMARY OF THE INVENTION

The object of the present invention is to provide a composition for making a water repellent paper, paperboard or cardboard with a low permeability for gas and moisture.

The composition of the present invention comprises components (A) to (C) and optionally one or several of components (D) to (H), in the following amounts by dry weight (wt):

(A) 5 to 89 wt % of polyvinyl butyral (PVB)
(B) 1 to 20 wt % of styrene maleic imide (SMI)
(C) 5 to 50 wt % of ethylene acrylate
(D) 0 to 20 wt % of water-soluble component, preferably polyvinyl alcohol or starch
(E) 0 to 7 wt % of wax
(F)) 0 to 6 wt % of styrene maleic anhydride copolymer (SMA) or salt thereof
(G) 0 to 70 wt % of synthetic binder, preferably styrene butadiene (SB) latex
(H) 0 to 70 wt % of mineral, preferably kaolin or talc

DETAILED DESCRIPTION OF THE INVENTION

The present invention is described in detail below. The aqueous emulsion or dispersion of the present invention contains the components (A), (B) and (C) described above as the essential components.

Component (A) is 5 to 89% by dry weight PVB. If the content of PVB in the composition of the present invention is below 5 wt %, the paper obtained with such emulsion or dispersion has poor water repulsive properties and a too low moisture permeability. A composition with more than 89 wt % of PVB has a too high shear resistance for being applied in a high speed paper coating process.

A preferred composition comprises 40 to 70 wt % PVB. Paper treated with a composition according to the invention comprising less than 70 wt % of PVB can be repulped using a low mixing speed while a paper produced from a thus obtained pulp exhibits low amount of sticky and agglomerated particles. Paper treated with a composition comprising at least 40 wt % of the PVB turned out to have an excellent resistance against penetration of liquids.

PVB generally is used as an emulsion in water. A suitable concentration of the PVB emulsion is about 50 wt %. A concentration above 50 wt % is hard to process due to its fast drying character.

The emulsion comprises PVB particles with a preferred average particle size of between 90 and 1000 nm. In order to stabilize the PVB emulsion, the emulsion further comprises an emulsifier. A suitable emulsifier for PVB in water is e.g. Castor oil or the like.

In general the PVB emulsion comprises at least 20 wt %, but more preferably at least 40 wt % of an emulsifier on 100 wt % of the PVB.

Component (B) comprises at most 20 wt %, preferably from 5 to 15 wt %, of a styrene maleic imide copolymer (SMI). More than 20 wt % should be avoided because of a too low thermosealability of a paper coated with the composition according to the invention. A preferred copolymer comprises between 20 and 30 wt % maleic monomer units.

Component (C) is an ethylene acrylate copolymer comprising from 5 to 30% by weight of ethylene and a particle size of between 100 and 1000 nm. Preferably the particle size is between 300 and 700 nm. Most preferably the particle size is between 450 and 550 nm. The amount of ethylene acrylate in the composition of the invention is between 5 and 50 wt %, preferably from 10 to 30 wt %. An amount of at least 5 wt % of ethylene acrylate is used to obtain a paper which is easily sealable with a water based glue, a hot melt or which is thermosealable. Compositions with more than 50 wt % exhibits a too high vapor transmission.

The composition of the invention may further comprise one or several of the following components:

(D) 0 to 20 wt % of water soluble component, preferably polyvinyl alcohol or starch
(E) 0 to 7 wt % of wax
(F) 0 to 6 wt % styrene maleic anhydride copolymer (SMA) or salt thereof
(G) 0 to 70 wt % of synthetic binder, preferably styrene butadiene (SB) latex
(H) 0 to 70 wt % of mineral, preferably kaolin or talc Component (D) comprises up to 20 wt % of water-soluble binder such as polyvinyl alcohol or starch and is generally added to improve the rheological properties of the composition. A suitable polyvinyl alcohol has a relatively high molecular weight, preferably more than 150.000 g/mol and has an as low as possible degree of soapification.

Component (E) is the emulsion of a wax having a melting point of from 50° C. to 100° C., preferably from 50° C. to 70° C. If the melting point thereof is too low, the paper obtained using the aqueous emulsion has poor adhesion properties, while if the melting point thereof is too high, the paper obtained has poor hydrophobic properties. The emulsion of wax which can be used in the present invention is, for example, a commercially available paraffin wax emulsion or microwax emulsion, and if desired and necessary, a mixture of these emulsions can be used.

Component (F) is a styrene maleic anhydride copolymer (SMA) or salt thereof comprising preferably between 20 and 50% by weight of maleic anhydride units. A suitable molecular weight of the SMA is between 80.000 and 150.000 g/mol. The amount of SMA in the composition of the invention is between 0 and 6 wt %, preferably from 0.1 to 4 wt %. Already an amount of less than 2 wt % of SMA improves the rheological behavior of the composition of the present invention. An additional advantage of SMA in compositions comprising up to 7 wt % of wax is that it prevents the migration of a, in particular low melting, wax to the surface of a paper coated with such composition. Compositions with more than 6 wt % of SMA should be avoided because of their hydrophilic character.

Component (G) is synthetic binder such as styrene butadiene (SB), acrylate, styrene acrylate or polyvinyl acetate latex, preferably styrene butadiene latex, which may be added to the composition of the invention in an amount of up to 70 wt %.

Component (H) is a mineral such as kaolin or talc. Use of kaolin or talc and especially the latter in the composition of the invention even further improves barrier properties and runnability of the paper.

The aqueous emulsion or dispersion of the present invention can be produced by, for example, the following method. The PVB emulsion as the component (A) is placed in a vessel equipped with a stirrer and stirred to an extent of not forming bubbles. An aqueous solution of SMI and the emulsion of ethylene acrylate are successively added to the mixture possibly followed by one or several of components (D) to (H). The aqueous emulsion or dispersion of the present invention can be thus obtained.

The invention further relates to an easily macerating moisture-proof paper comprising a base paper being coated on at least one surface thereof a layer of an aqueous emulsion or dispersion comprising a water-dispersible composition according to the invention, wherein the solid content in the aqueous emulsion is from 30 to 65% by weight. Preferably the solid content is from 45 to 50% by weight. Within the range from 30 to 60 wt % the viscosity of the composition according to the invention is suitable for processing on a paper coating machine. The viscosity of a composition with 45 to 50 wt % of solid content allows processing on high speed paper coating machines.

The easily macerating moisture-proof paper of the present invention is obtained by coating the aqueous emulsion on at least one surface of a base paper in an amount of from 0.5 to 25 g/m$^2$, preferably from 5 to 15 g/m$^2$. If the amount of the aqueous emulsion used is below 8 g/m$^2$, the paper obtained has low moisture-proof property and water repellency by the formation of pinholes and the occurrence of fluffing of the fibers of the base paper, while if the amount of the aqueous emulsion is above 25 g/m$^2$ no relevant improvement of the vapor transmission rate is obtained. However in certain applications, e.g. surface sizing, even low coat weights, such as from 0.5 to 2 g/m$^2$, may give required improvement to paper properties.

A kraft paper, a wood free paper, a corrugated board base paper, etc., can be used as the base paper, but the base paper used in the present invention is not limited to those.

For obtaining the easily macerating moisture-proof paper of the present invention, for example, the definite amount of the aqueous emulsion is coated on a base paper with e.g. a blade coater, a roller coater, a film transfer coater, a spray coater, a curtain coater or an airknive coater, and dried properly, even at a temperature of higher than about 125° C. and up to 200° C. In addition, when the drying temperature is too low, it sometimes happens that the easily macerating moisture-proof paper obtained is inferior in the moisture-proof property.

The easily macerating moisture-proof paper of the present invention is most suitably used in a wide field, for example as a wrapping paper, a water-resistant corrugated fiberboard paper or a wrapping paper for copying paper, owing to the excellent characteristics.

An extra advantage of the present invention is that the composition according to the invention is free of halogens, has a high resistance against liquids and can be applied on-line on a paper production machine. A paper treated with the composition of the invention exhibits a high oxygen barrier, which makes it very suitable for the packaging of food.

EXPERIMENTAL

The present invention is explained in more detail by the Examples I to X according to Table 1 and Table 2.

Aqueous compositions were obtained with amount of the components (A) to (H) as shown in Table 1. For each of the compositions coated paper was made under the following coating condition: Each coated paper was obtained by coating each aqueous emulsion on a paper or cardboard having a basis weight as given in Table 2 with a roller coater at a coating amount as shown in Table 2.

The coated paper was dried at 140° C. and items of the vapor transmission rate, the water repellency, the friction coefficient, and the grease resistance were evaluated as follows.

The vapor transmission rate was measured as cup method according to DIN 53122.

The water repellency was measured according to the Cobb method during 3 respectively 10 minutes with a kraft paper treated with 8 g/m$^2$ of a composition according to Table 1.

The grease resistance is measured according to the Kitt test according to 3M.

The friction coefficient (C.O.F) was measured with a weight of 1 kg on a variable slope. The ratings "low", "medium" and "high" were given.

The results obtained are shown in Table 2.

TABLE 1

| | Composition - (wt %) | | | | | | | |
|---|---|---|---|---|---|---|---|---|
| | 1 | 2 | 3 | 4 | 5 | 6 | 7 | 8 |
| PVB | 35.00 | 45.00 | 38.00 | 48.00 | 40.00 | 38.00 | 35.00 | 70.00 |
| SMI | 2.00 | 4.00 | 6.00 | 2.00 | 5.00 | 4.00 | 4.00 | 2.00 |
| Ethylene Acrylate | 12.00 | 15.00 | 15.00 | 15.00 | 10.00 | 15.00 | 12.00 | 25.00 |
| Wax | 0.00 | 1.00 | 7.00 | 3.00 | 3.50 | 7.00 | 7.00 | 2.00 |
| SMA | 1.00 | 0.00 | 1.00 | 0.00 | 1.50 | 1.00 | 1.00 | 1.00 |
| SB | 35.00 | 35.00 | 33.00 | 32.00 | 30.00 | 35.00 | 31.00 | |
| Talc | 15.00 | 0.00 | 0.00 | 0.00 | 10.00 | 0.00 | 10.00 | |

TABLE 2

| Exp. | Formula | Basic paper | Sizepress-treatment and weight/$m^2$ | Coating weight $m^2$ | Total weight | Cobb 3 min H2O g/$m^2$ | Cobb 10 min H2O g/$m^2$ | Kitt 3 M test | C.O.F low medium High | Vapor transmission 60% RH at +35° C. g/$m^2$ after 24 h DIN | Vapor transmission 90% RH at +38° C. g/$m^2$ after 24 h DIN |
|---|---|---|---|---|---|---|---|---|---|---|---|
| I | 1 | Cardboard 295 g | Starch 2 g | 18 g | 20 g | 3 | 8 | 14 | M | 85 g/$m^2$ | 135 g/$m^2$ |
| II | 2 | Cardboard 295 g | SMI 40% 2 g | 18 g | 20 g | 6 | 14 | 11 | L | 30 g/$m^2$ | 50 g/$m^2$ |
| III | 3 | Paper 90 g | Pretop 601-1.5 g | 17.5 g | 20 g | 3 | 6 | 13 | H | 18 g/$m^2$ | 29/$m^2$ |
| IV | 3 | Paper 90 g caland. | Pretop 601-1.5 g | 17.5 | 20 g | 1 | 4 | 14 | H | 11 g/$m^2$ | 20/$m^2$ |
| V | 3 | Cardboard 295 g | Starch 2 g | 10 g | 12 g | 5 | 11 | 13 | H | 32 g/$m^2$ | 64 g/$m^2$ |
| VI | 4 | Cardboard 295 g | | 18 g | 18 g | 3 | 7 | 9 | L | 34 g/$m^2$ | 70 g/$m^2$ |
| VII | 5 | Cardboard 265 g | Starch + fluortreatm. | 20 g | 21.5 g | 8 | 17 | 14 | M | 70 g/$m^2$ | 106 g/$m^2$ |
| VIII | 6 | Cardboard 265 g | Starch + fluortreatm. | 16 g | 17 g | 0 | 4 | 14 | M | 15 g/$m^2$ | 19/$m^2$ |
| IX | 7 | Cardboard 265 g | Starch + fluortreatm. | 19 | 20 g | 0 | 5 | 13 | M | 36 g/$m^2$ | 76 g/$m^2$ |
| X | 8 | Cardboard 265 g | Starch + fluortreatm. | 10 g | 20 g | 0 | 5 | 14 | H | 45 g/$m^2$ | 89 g/$m^2$ |

The invention claimed is:

1. A composition comprising components (A) to (C)

(A) 5 to 89 wt % of polyvinyl butyral (PVB), (B) 1 to 20 wt % of styrene maleic imide (SMI) and (C) 5 to 50 wt % of ethylene acrylate, and optionally one or several of components selected from the group consisting of (D) to (H), in the following amounts by dry weight (wt)

(D) 0 to 20 wt % of water-soluble component, preferably polyvinyl alcohol or starch, (E) 0 to 7 wt % of wax, (F) 0 to 6 wt % of styrene maleic anhydride copolymer (SMA) or salt thereof, (G) 0 to 70 wt % of synthetic binder, preferably styrene butadiene (SB) latex and (H) 0 to 70 wt % of mineral, preferably kaolin or talc.

2. Composition according to claim 1, wherein the amount of component (A) is between 40 and 70 wt %.

3. Composition according to claim 1, wherein the amount of component (B) is between 5 and 15 wt %.

4. Composition according to claim 1, wherein the amount of component (C) is between 10 and 30 wt %.

5. Composition according to claim 1, wherein the amount of component (F) is between 0.1 and 4 wt %.

6. An aqueous emulsion or dispersion comprising the composition according to claim 1.

7. Aqueous emulsion or dispersion according to claim 6, wherein the solid content is from 30 to 65%.

8. Paper, paperboard or cardboard coated on at least one surface with the composition according to claim 1.

9. Paper, paperboard or cardboard according to claim 8, wherein the amount of the composition is from 0.5 to 25 g/$m^2$.

10. Paper, paperboard or cardboard according to claim 9, wherein the amount of the composition is from 5 to 15 g/$m^2$.

11. Composition according to claim 2, wherein the amount of component (B) is between Sand 15 wt %.

12. Composition according to claim 2, wherein the amount of component (C) is between 10 and 30 wt %.

13. Composition according to claim 3, wherein the amount of component (C) is between 10 and 30 wt %.

* * * * *